US009625140B2

(12) United States Patent
Lorenz

(10) Patent No.: US 9,625,140 B2
(45) Date of Patent: Apr. 18, 2017

(54) ILLUMINATING ELEMENT HAVING A CODING ELEMENT

(71) Applicant: OSRAM GmbH, Munich (DE)

(72) Inventor: Stefan Lorenz, Obertraubling (DE)

(73) Assignee: OSRAM GmbH, Munich (DE)

( * ) Notice: Subject to any disclaimer, the term of this patent is extended or adjusted under 35 U.S.C. 154(b) by 59 days.

(21) Appl. No.: 14/377,879

(22) PCT Filed: Feb. 14, 2013

(86) PCT No.: PCT/EP2013/053005

§ 371 (c)(1),
(2) Date: Aug. 11, 2014

(87) PCT Pub. No.: WO2013/120961

PCT Pub. Date: Aug. 22, 2013

(65) Prior Publication Data

US 2015/0023061 A1 Jan. 22, 2015

(30) Foreign Application Priority Data

Feb. 16, 2012 (DE) ..... 10 2012 202 348

(51) Int. Cl.

| | |
|---|---|
| ***H01R 33/00*** | (2006.01) |
| ***F21V 23/04*** | (2006.01) |
| ***F21K 9/00*** | (2016.01) |
| ***F21V 17/00*** | (2006.01) |
| ***F21K 9/232*** | (2016.01) |
| *F21Y 101/00* | (2016.01) |

(52) U.S. Cl.

CPC ..... *F21V 23/04* (2013.01); *F21K 9/00* (2013.01); *F21K 9/232* (2016.08); *F21V 17/005* (2013.01); *F21Y 2101/00* (2013.01)

(58) Field of Classification Search

CPC . F21V 3/00; F21V 23/04; F21V 23/06; F21V 23/009; F21V 17/005; F21K 9/135; F21K 9/10; F21K 9/1375; F21K 9/1355; F21K 9/175; F21K 9/00; F21Y 2101/02; H01R 33/962; H01R 33/96; H01K 5/0091; H05B 41/295; F21S 9/022

USPC ..... 362/640, 226

See application file for complete search history.

(56) References Cited

U.S. PATENT DOCUMENTS 2,980,784 A * 4/1961 Gohs ..... H01H 9/162 200/314
4,561,045 A * 12/1985 Nishi ..... H01H 13/023 362/368
8,636,391 B2 1/2014 Dellian et al.

FOREIGN PATENT DOCUMENTS

DE 29623442 U1 7/1998
DE 202008015948 U1 2/2009

(Continued)

OTHER PUBLICATIONS

International Search Report of PCT/EP2013/053005 mailed Apr. 22, 2013.

(Continued)

*Primary Examiner* — Jason Moon Han
*Assistant Examiner* — Omar Rojas Cadima
(74) *Attorney, Agent, or Firm* — Viering, Jentschura & Partner mbB

(57) ABSTRACT

A light-emitting element may include at least one coding element. The coding element may have at least two switching states and an operating mode of the light-emitting element may be set on the basis of a switching state of the coding element.

12 Claims, 2 Drawing Sheets

(56) References Cited

FOREIGN PATENT DOCUMENTS

| | | | |
|---|---|---|---|
| DE | 102010003717 | A1 | 10/2011 |
| DE | 102010019875 | A1 | 11/2011 |
| GB | 2466809 | A | 7/2010 |
| WO | 2012010995 | A1 | 1/2012 |

OTHER PUBLICATIONS

German Office Action received on Jul. 21, 2014 in the German priority application No. 10 2012 202 348.8.
English language abstract of DE 29623442 U1 dated Jun. 10, 1998.

* cited by examiner

ILLUMINATING ELEMENT HAVING A CODING ELEMENT

RELATED APPLICATIONS

The present application is a national stage entry according to 35 U.S.C. §371 of PCT application No.: PCT/EP2013/053005 filed on Feb. 14, 2013, which claims priority from German application No.: 10 2012 202 348.8 filed on Feb. 16, 2012, and is incorporated herein by reference in its entirety.

TECHNICAL FIELD

Various embodiments relate to a light-emitting element having at least one coding element.

BACKGROUND

So-called LED modules (LED: light-emitting diode; an LED module includes, for example, at least one semiconductor light-emitting element and, for example, at least one further functional element, for example an electronic, optical or mechanical component) are known as luminous bodies. In the case of such LED modules having a socket which is adapted thereto (for example, for mounting in a luminaire), there can be a plurality of variants. In particular, variants for different grid voltages are possible. Since the electronics system used on the luminous body or module must be configured for a defined input voltage, the modules and sockets are protected by means of coding elements against accidental interchange. A module of one variant thus fits only into a corresponding associated socket and not into a socket of another variant.

For different input voltages as operating modes which are different from one another, different LED modules having respectively adapted electronics systems are used. Each LED module may include a specific fixed coding element which enables the module to be inserted into only that socket which also ensures an appropriate voltage supply. Thus, the LED module can only be operated with the appropriate voltage.

It is known to provide an LED module with an electronics system which is suitable for a multiplicity of different input voltages. Said LED module can be used without a coding element in sockets with different voltage supplies.

In this connection, it is disadvantageous that the LED module has an elaborate and expensive electronics system in order to be able to suitably convert different grid voltages. By way of example, different converters (step-up converters, step-down converters, etc.) are required to this end in order to suitably supply the LED module on the basis of an unknown grid voltage. An electronics system such as this is relatively expensive and often requires installation space which is often not present in the LED modules or which is required for other purposes, for example for cooling means.

SUMMARY

The problem addressed by the present disclosure consists in avoiding the disadvantages mentioned above and, in particular, specifying a light-emitting element having at least one coding element, which nevertheless enables, in an even simpler design, use in different operating modes, in particular in the case of different input voltages.

In various embodiments, a light-emitting element having at least one coding element is provided, wherein the coding element can have at least two switching states and an operating mode of the light-emitting element can be set on the basis of a switching state of the coding element.

For this purpose, the coding element is embodied in an adjustable manner, such that, by means of said adjustment, a plurality of switching states—in particular, two—of the coding element can be set. The switching states are preferably set by means of setting in a socket which has corresponding cutouts or projections for this purpose in order to adjust the coding element, wherein the coding element correspondingly has projections or cutouts.

Thus, a voltage adaptation is made possible by means of one or more switchable coding elements. By means of the coding element, a switching function can take place in the light-emitting element, with the result that, depending on the setting of the coding element, a circuit for operation of the light-emitting element at 220 V or a circuit for operation of the light-emitting element at 110 V is active. By way of example, by means of the coding element, in this way a voltage divider can be efficiently alternately switched such that the light-emitting element can be operated with half or double the grid voltage. This considerably simplifies the circuit expense in the light-emitting element and, at the same time, increases the flexibility thereof. Thus, no expensive and bulky step-up converters and/or step-down converters, on the basis of which different grid voltages are transformed to the voltage level of the light-emitting element, are necessary.

One or optionally also two or more alternating, movable coding elements, which are designed as switches or are connected to a switch, give the light-emitting element or the module thereof information about the variant of the socket as soon as said light-emitting element or module is inserted into the socket. In particular, as a result, the appropriate input voltage can be automatically switched in the electronics system, in particular in a mechanical way.

One development is that the light-emitting element is configured with a base, on and/or in which the coding element is arranged. Arranging the coding element on the base makes it possible to modify and use bases which are known per se in terms of construction for inserting the light-emitting element having a coding element, and to switch on the operating modes on the basis of the socket.

Another development is that the coding element can be pressed into the base to adjust the switching state, in particular is designed to be able to be pressed in. Hence, two different switching states can be defined in a simple manner. In one of the switching states, the coding element latches, for example, in a corresponding cutout of the socket. In a second switching state, the coding element is pressed in by the socket wall lying opposite and switches the second switching state. Other switching configurations can be, for example, a switching element in the sense of a changeover switch, rocker switch or a rotatable switch.

In particular, one development is that, in the light-emitting element, the coding element switches a first operating mode in the not-pressed in switching state and a second operating mode in the at least partially pressed in switching state. The coding element thus acts like a switch which changes over between two different switching states. However, other switching states can also be provided, which are switched by different press-in depths of the coding element, for example.

It is also a development that the coding element is designed as a mechanical switch element or key element. This enables a technically simple construction and a changeover between electronic components which implement an adaptation in terms of circuitry to different grid voltages. In addition, other switch types can be used. A simple mechanical mechanism, in particular switch, can perform the necessary voltage conversion in the module. A detection electronics system for ascertaining the grid voltage (or any other voltage) can be omitted in this way.

In the context of an additional development, the operating mode or an electronics system of the light-emitting element is configured to take on defined, in particular discretely defined, operating states on the basis of the present switching state of the light-emitting element. A discretely defined switching state is understood to mean that the respective switching state corresponds to a determined input voltage applied to the light-emitting element. Thus the use of particularly simple and therefore inexpensive electronic components is made possible. By way of example, a series/parallel circuit composed of two electronic blocks can be provided in order, for example, to connect the two blocks in parallel for the voltage of 110 V and to connect the two blocks in series for the voltage of 220 V.

A subsequent development consists in that the operating mode of the light-emitting element is based on an output or grid voltage of a socket into which the light-emitting element can be inserted. Accordingly, a voltage selection of the input voltage is then adjustable as operating mode depending on the socket type and the output or grid voltage thereof. Thus, an individual module type can be provided for both or optionally also more voltage ranges.

One configuration is that the coding element is designed to assume the different switching states on the basis of a socket, into which the light-emitting element can be inserted. Hence, the insertion of the light-emitting element in sockets of existing light-emitting element socket systems is possible.

Another configuration consists in that the coding element is arranged such that a switching state is set before a voltage is applied. By way of example, the coding element projects so far into a socket during the insertion of the module or the base of the light-emitting element that, firstly, adjustment of the coding element must take place before electrical contact is made. Movable coding elements such as this, which are designed as switches or which are connected to a switch, give the light-emitting element or the module thereof information about the variant of the socket as soon as said light-emitting element or module is inserted, that is to say before the voltage is applied. As a result, the appropriate input voltage can already be switched in the electronics system before the actual application of the voltage. The voltage information is available by means of the insertion of the coding element before the application of the voltage. Circuits for protecting against surges can preferably thus be omitted.

A light-emitting element such as this is designed, in particular as a lamp or semiconductor light-emitting element, in particular a light-emitting diode or a retrofit light-emitting element. Thus, in particular, an LED module having an electronics system which is suitable for determined, predefined input voltages, is provided.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
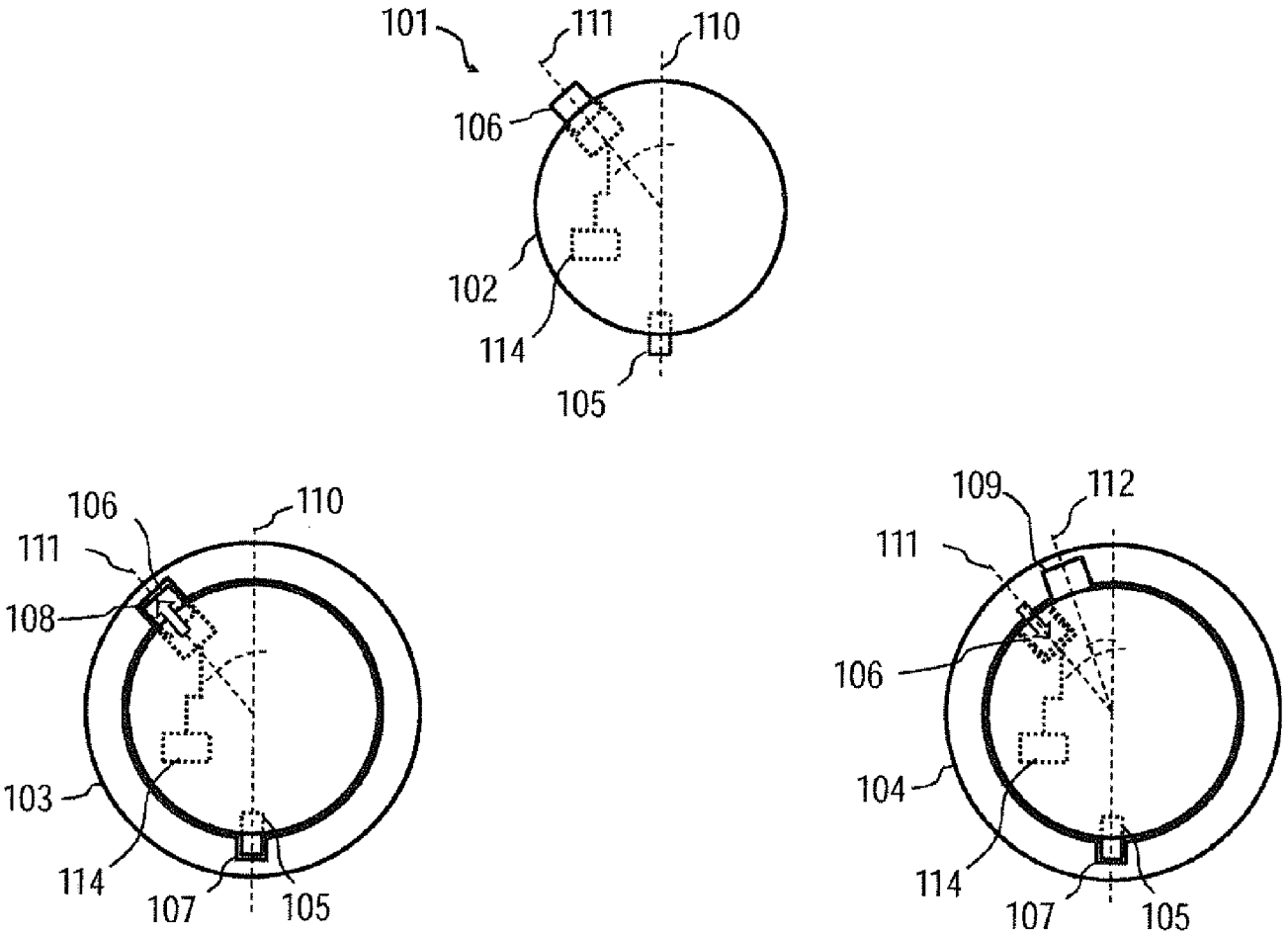
FIG. 1 schematically shows individual components of a light-emitting element, in which an operating mode of the light-emitting element can be set on the basis of the switching state of an adjustably designed coding element, wherein the light-emitting element is additionally illustrated in two different operating states.

FIG. 1 shows, in the center at the top, a light-emitting element 101 in an exemplary view from below of a base 102 of the light-emitting element. In addition to the outlined components, the light-emitting element 101 has further components, for example at least one lamp, in particular a semiconductor light-emitting element, a light-emitting diode (LED) and contact elements on the base 102 for the application of a current or a voltage.

The light-emitting element 101 can be inserted with its base 102 into variously configured sockets 103, 104, as is outlined at the lower left and right in FIG. 1. The sockets 103, 104 differ from one another in that, for example, they provide and apply different voltages to the contact elements of an inserted light-emitting element 101. By way of example, the first socket 103 provides a voltage of 220 V and the second socket 104 provides a voltage of 110 V.

In order to prevent accidental insertion of the wrong light-emitting element, said sockets 103, 104 are differently coded. The coding consists of cutouts being mating coding elements 107, 108 or 109, which are formed in the inner circumference of the receiving area of the sockets 103, 104. When such a light-emitting element 101 is inserted, coding elements 105, 106 engage, in particular in a precisely fitting manner, in the mating coding elements 107, 108. By way of example, the coding elements 105, 106 protrude as pin-like projections from the outer circumference of the base 102.

In this case, a first pair consisting of such a coding element 105 and such a mating coding element 107 is used to align the light-emitting element 101 to be inserted in a defined position of the light-emitting element 101 with respect to the socket 103 or 104. At least one further pair consisting of such a coding element 106 and such a mating coding element 108 is arranged on the circumference of the base 102 and on the inner circumference of the socket 103 offset with respect to the first pair at another defined position on the circumference, as is outlined at the lower left in FIG. 1. As a result, normally actually only one light-emitting element 101 such as this can be inserted with its base 102 into the socket 103, which, in terms of the functionality of said light-emitting element, in particular the voltage, matches the functionality of the socket 103. The position of the second pair consisting of the coding element 106 and the mating coding element 108 is along a second orientation line 111 which is offset by a first angle with respect to a first orientation line 110 which leads through the first pair consisting of the coding element 105 and the mating coding element 107 and the center of the socket.

In the case of the socket 104 at the lower right in FIG. 1, a second pair consisting of a coding element and a mating coding element 109 is also provided on the circumference of the base and on the inner circumference of the socket 104; however, this is provided at another position, such that consequently another functionality, in particular voltage, of the light-emitting element can be coded. The position of the further provided second pair consisting of the coding element and the mating coding element 109 is along a third orientation line 112 with respect to the first orientation line 110 and is not the same as the second orientation line 111.

In order to enable the insertion of the same light-emitting element 101 into this second socket 104, too, the coding element 106 is adjustably arranged on the base 102. In particular, the coding element 106 can be pressed in and thus also inserted into the socket 104, as is outlined at the lower right in FIG. 1. In order to bring the pressed-in or pushed-in coding element 106 into the original position again once the light-emitting element 101 has been removed from the socket 104, said coding element can be embodied in an elastic way (for example with a spring).

In order that the light-emitting element 101 is not damaged during insertion into the socket 104 or that the functionality of the light-emitting element 101 is ensured, the voltage for operating the light-emitting element 101 is adapted on the basis of the state of the coding element 106. When the coding element 106 is pressed in, a changeover to another supply voltage for the light-emitting element 101 can occur.

For the purpose of changing over, the coding element 106 is designed, for example, as a switch which, depending on the switching state, influences an electronics system 114 or circuit of the light-emitting element 101. By way of example, voltage dividers or circuit blocks can be switched in a different way in the circuit depending on the switching state of the switch 106. The electronics system 114 effects different modes for operating the light-emitting element 101 at different voltages.

Figure 2:
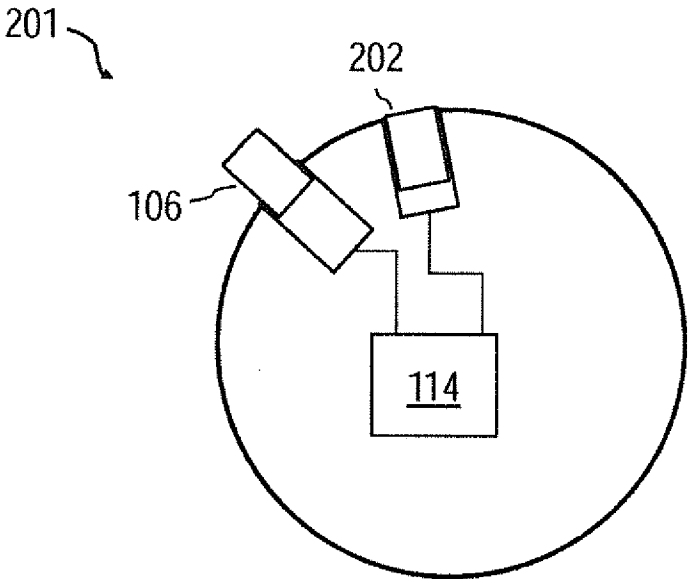
FIG. 2 shows a light-emitting element which has been modified in comparison with the one in FIG. 1.

FIG. 2 shows a modified light-emitting element 201. Said modified light-emitting element has, in addition to the adjustable coding element 106, a further adjustable coding element 202. Both coding elements 106, 202 are connected to the circuit 114.

Owing to the use of the light-emitting element 201, different evaluable operating modes occur on the basis of the positions of the coding elements 106 and 202. If two states (on/off) are possible per coding element 106, 202 then, in total, four discernible operating modes arise from two coding elements. Thus, by means of n coding elements, $2^n$ states can be coded.

Alternatively, it is possible for coding elements to be embodied as changeover switches, that is to say that a mechanical coupling between coding elements occurs, with the result that the state of one coding element influences the state of the other coding element.

Further Advantages:

For example, alternating coding elements may also be used. When the adjustable coding element of a first variant is pushed in, the other coding element, which is also adjustable and is according to an adjustable variant for a socket having a mating coding recess which is positioned differently, is automatically and, in particular, mechanically pushed out.

According to another configuration, the coding element can also not be pushed in but folded away along an axis, for example parallel to the plane of the drawing.

The coding element may also be movably mounted and is, for example, shifted from the mating element coding position of the mating coding element 109 of the socket 104 to the mating element coding position of the mating coding element 108 of the first socket 103 during or before insertion into the socket 103.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

REFERENCE SIGNS

101 light-emitting element
102 base
103 socket for one operating state
104 further socket for another operating state
105 fixed coding element
106 adjustable coding element
107 mating coding element
108 mating coding element
109 mating coding element
110 orientation line
111 second orientation line
112 third orientation line
114 electronics system
201 light-emitting element
202 further adjustable coding element

The invention claimed is:

1. A light-emitting element, comprising a base, at least one coding element arranged on or in the base, the coding element corresponding to a mating coding element arranged on or in a socket, wherein the at least one coding element has at least two possible switching states when the base is fully inserted into the socket, wherein at least one of said switching states does not correspond to the mating coding element;

wherein an operating mode of the light-emitting element is settable on the basis of the switching state of the coding element;

wherein the operating mode of the light-emitting element is based on an output or grid voltage of the socket, into which the light-emitting element is inserted;

wherein the grid voltage is one of at least two different non-zero mains voltages;

wherein the at least two possible switching states correspond to different non-zero mains voltages.

2. The light-emitting element as claimed in claim 1, wherein the coding element is designed to be able to be pressed into the base to adjust the switching state.

3. The light-emitting element as claimed in claim 1, wherein the coding element switches a first operating mode in a not-pressed in switching state and a second operating mode in an at least partially pressed in switching state.

4. The light-emitting element as claimed in claim 1, wherein the coding element is designed as a mechanical switch element or key element.

5. The light-emitting element as claimed in claim 1, wherein the operating mode or an electronics system of the light-emitting element is configured to take on defined operating states on the basis of the present switching state of the light-emitting element.

6. The light-emitting element as claimed in claim 1, wherein the coding element is designed to assume the different switching states on the basis of the socket, into which the light-emitting element is inserted.

7. The light-emitting element as claimed in claim 1, wherein the coding element is arranged such that a switching state is set before a voltage is applied.

8. The light-emitting element as claimed in claim 1, wherein the light emitting element is designed as a lamp or semiconductor light-emitting element.

9. The light-emitting element as claimed in claim 1, wherein the operating mode or an electronics system of the light-emitting element is configured to take on discretely defined operating states on the basis of the present switching state of the light-emitting element.

10. The light-emitting element as claimed in claim 1, wherein the light-emitting element is designed as a LED module or retrofit light-emitting element.

11. The light-emitting element as claimed in claim 1, wherein the at least one of said coding elements prevents insertion of the base into the socket.

12. The light-emitting element as claimed in claim 11, wherein said insertion is prevented by physical interference between the coding element and the mating coding element.

* * * * *